US009856616B2

(12) United States Patent
Sicking et al.

(10) Patent No.: US 9,856,616 B2
(45) Date of Patent: Jan. 2, 2018

(54) SELF-RESTORING CRASH CUSHIONS

(71) Applicant: THE UAB RESEARCH FOUNDATION, Birmingham, AL (US)

(72) Inventors: Dean Sicking, Indian Springs Village, AL (US); David Littlefield, Vestavia Hills, AL (US); Kenneth Walls, Moody, AL (US); Seth Cohen, Birmingham, AL (US); Kevin Schrum, Birmingham, AL (US)

(73) Assignee: The UAB Research Foundation, Birmingham, AL (US)

( * ) Notice: Subject to any disclaimer, the term of this patent is extended or adjusted under 35 U.S.C. 154(b) by 0 days.

(21) Appl. No.: 15/124,073

(22) PCT Filed: Mar. 7, 2015

(86) PCT No.: PCT/US2015/019335
§ 371 (c)(1),
(2) Date: Sep. 7, 2016

(87) PCT Pub. No.: WO2015/134957
PCT Pub. Date: Sep. 11, 2015

(65) Prior Publication Data

US 2017/0016191 A1 Jan. 19, 2017

Related U.S. Application Data

(60) Provisional application No. 61/949,516, filed on Mar. 7, 2014.

(51) Int. Cl.

| | |
|---|---|
| ***E01F 15/00*** | (2006.01) |
| ***E01F 15/14*** | (2006.01) |
| ***B66D 1/60*** | (2006.01) |

(52) U.S. Cl.
CPC ..... *E01F 15/146* (2013.01); *B66D 1/60* (2013.01); *E01F 15/143* (2013.01); *B66D 2700/0125* (2013.01)

(58) Field of Classification Search
CPC . B66D 1/60; B66D 2700/0125; E01F 15/143; E01F 15/146
USPC ..... 404/6
See application file for complete search history.

(56) References Cited

U.S. PATENT DOCUMENTS

| | | | |
|---|---|---|---|
| 3,674,115 | A | 7/1972 | Young et al. |
| 4,407,484 | A | 10/1983 | Meinzer |
| 5,011,326 | A | 4/1991 | Carney, III |
| 5,022,782 | A | 6/1991 | Gertz et al. |
| 6,539,175 | B1 | 3/2003 | Geary et al. |

(Continued)

OTHER PUBLICATIONS

International Search Report for PCT/US2015/019335 dated Jun. 19, 2015.

*Primary Examiner* — Raymond W Addie
(74) *Attorney, Agent, or Firm* — Thomas | Horstemeyer, LLP

(57) ABSTRACT

A self-restoring crash cushion including multiple diaphragms spaced along a length direction of the cushion, an elongated track adapted to be anchored to the ground that extends along the length direction under the cushion, the diaphragms being mounted to the track in a manner in which they can slide along the track when impacted by a moving vehicle or when the cushion is being restored, and means for dissipating energy of the moving vehicle.

20 Claims, 10 Drawing Sheets

(56) References Cited

U.S. PATENT DOCUMENTS

| | | | | |
|---|---|---|---|---|
| 6,962,459 | B2 * | 11/2005 | Smith | E01F 15/146 256/13.1 |
| 7,736,084 | B2 * | 6/2010 | Causey | E01F 13/048 256/13.1 |
| 2002/0109131 | A1 | 8/2002 | Smith et al. | |
| 2003/0165356 | A1 * | 9/2003 | Breed | B60R 19/00 404/6 |
| 2005/0084328 | A1 * | 4/2005 | Alberson | E01F 15/146 404/6 |
| 2009/0032789 | A1 | 2/2009 | Kennedy, Jr. et al. | |
| 2011/0001102 | A1 * | 1/2011 | Hossler | B66D 5/10 254/322 |

* cited by examiner

SELF-RESTORING CRASH CUSHIONS

CROSS-REFERENCE TO RELATED APPLICATION

This application is the 35 U.S.C. §371 national stage application of PCT Application No. PCT/US2015/019335, filed Mar. 7, 2015, where the PCT claims priority to U.S. Provisional Application Ser. No. 61/949,516, filed Mar. 7, 2014, which is hereby incorporated by reference herein in its entirety.

BACKGROUND

There are three distinct performance measures used to categorize roadside crash cushions, including redirective/non-redirective, gating/non-gating, and restorable/sacrificial energy absorbers. The first category refers to the capability of the crash cushion to contain and redirect oblique impacts into the rear of the cushion while the second category refers to the capability of the vehicle to break through the system during end-on impacts and travel behind the cushion and any barrier to which it is attached.

The third category refers to whether or not the crash cushion can be restored and reused after an impact without replacement of energy-dissipative components. A major consideration in relation to the third category is cost, specifically the cost for repairing the system after an impact. Sacrificial crash cushions utilize energy-absorbing elements that must be replaced after every impact. Restorable crash cushions utilize reusable components and, after most impacts, merely need to be pulled back into position. Because the costs for reusable crash cushions are much greater than those for cushions with replaceable energy absorbers, the most widely used crash cushions fall into the sacrificial category. It is estimated that more than 3,500 sacrificial crash cushions are sold in this country every year at a total cost in excess of $35 million.

Because the expenses associated with replacing energy absorbers can be high, it is desirable to use restorable crash cushions. It would be desirable to have restorable crash cushions that are relatively inexpensive to install, maintain, and restore.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, it would be desirable to have restorable crash cushions that are relatively inexpensive to install, maintain, and restore. Disclosed herein are self-restoring crash cushions that satisfy at least some of these goals. The self-restoring crash cushions comprise multiple diaphragms to which lateral fender panels can attach. The diaphragms are mounted to elongated tracks that extend along the length direction of the crash cushion and can travel along the track when the cushion is impacted on its front end by a moving vehicle. As the diaphragms move along the tracks, they dissipate the energy of the impact and slow the vehicle to a stop. After the vehicle is removed, the diaphragms can be moved back to their original positions along the length of the tracks so that the crash cushion is prepared for the next impact. As described below, there are several different ways in which the movement of the diaphragms along the tracks can be slowed to dissipate energy as well as several different ways in which the diaphragms can be returned to their original locations along the tracks to restore the crash cushion.

In the following disclosure, various specific embodiments are described. It is to be understood that those embodiments are example implementations of the disclosed inventions and that alternative embodiments are possible. All such embodiments are intended to fall within the scope of this disclosure.

Figure 1:
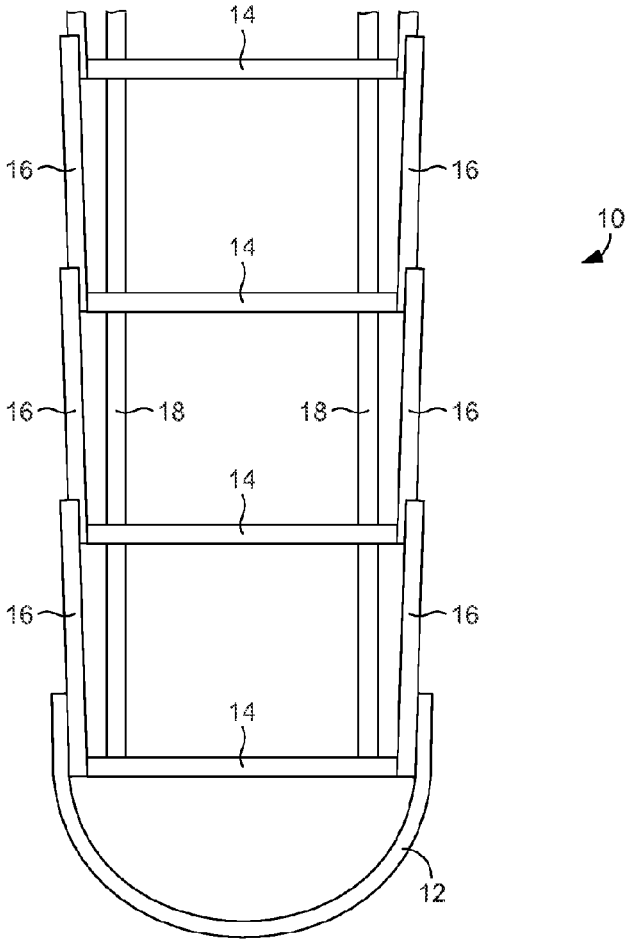
FIG. 1 is partial schematic plan view of a self-restoring crash cushion.

FIG. 1 schematically illustrates a portion of a self-restoring crash cushion 10 in plan view. As shown in the figure, the illustrated crash cushion 10 generally comprises a nose 12 that is provided at a leading or front end of the cushion and multiple spaced diaphragms 14 that are positioned along the length of the cushion between the nose and the trailing or rear end of the cushion (the rear end not shown in FIG. 1). Each of the diaphragms 14 supports at least one lateral fender panel 16 that is designed to redirect vehicles striking the side of the crash cushion 10. As shown in the figure, the fender panels 16 can be arranged in an overlapping configuration in which the trailing end of each adjacent fender panel overlaps the leading end of each adjacent fender panel as the crash cushion 10 is traversed from front to rear. With such a configuration, the fender panels 16 can slide over each other when a vehicle impact collapses the crash cushion 10 along its length. In some embodiments, the fender panels 16 are slotted (not shown) to facilitate such functionality and to keep the panels upright during the impact. The fender panels 16 are made of a strong material, such as high-strength steel.

Figure 2:
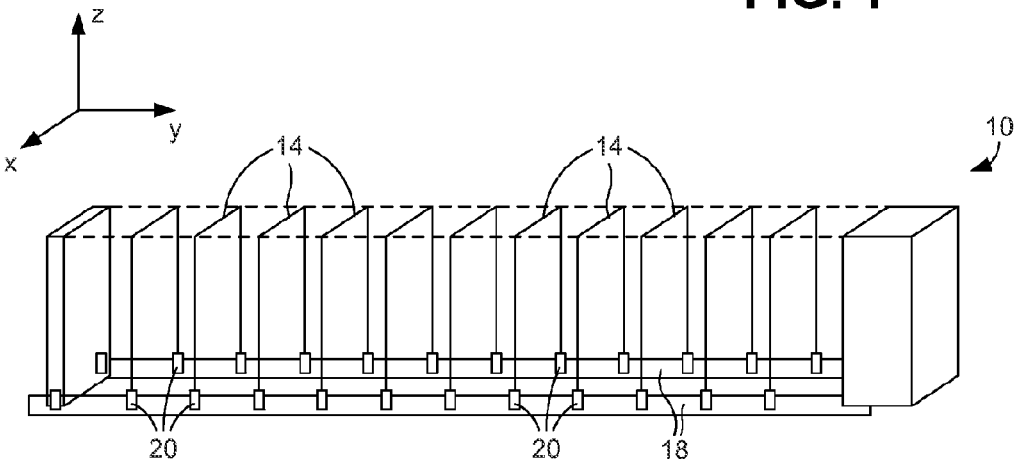
FIG. 2 is schematic perspective side view of the self-restoring crash cushion of FIG. 1.

With reference to FIG. 2, which schematically illustrates the crash cushion 10 with the nose 12 and the fender panels 16 removed and multiple diaphragms 14 shown in outline form, the diaphragms 14 extend from one side of the crash cushion 10 to the other. The diaphragms can comprise frames that are constructed from thick high-strength steel tubing (the diaphragms are generically represented in the figures for simplicity and clarity). Each diaphragm 14 is mounted on elongated parallel tracks 18 that are securely anchored to the ground (e.g., to concrete pad or other stable ground structure) and extend along the length of the crash cushion 10. Like the diaphragms 14 and the fender panels 16, the tracks 18 can be made of high-strength steel. The tracks 18 support the diaphragms 14 and provide resistance to lateral loads during side impacts. In addition, the tracks 18 enable the diaphragms 14 to slide down the lengths of the tracks to enable the crash cushion 10 to collapse. As indicated in FIG. 2, the diaphragms 14 mount to the tracks 18 with feet 20, which provide for this sliding functionality.

Figure 3A:
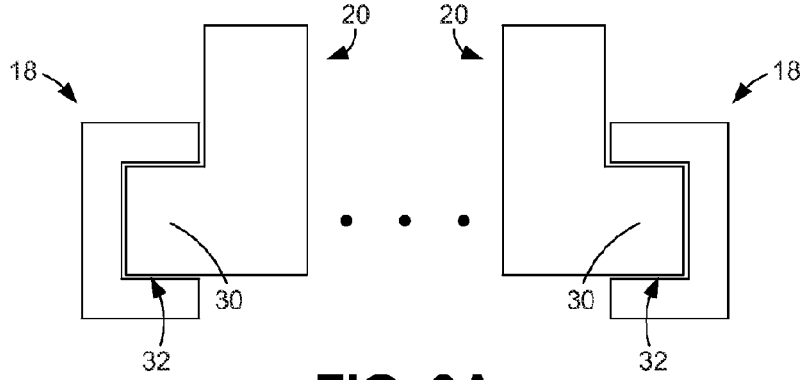
FIGS. 3A-3C are end views of embodiments of feet and tracks that can be used in the self-restoring crash cushion of FIGS. 1 and 2.
Figure 3B:
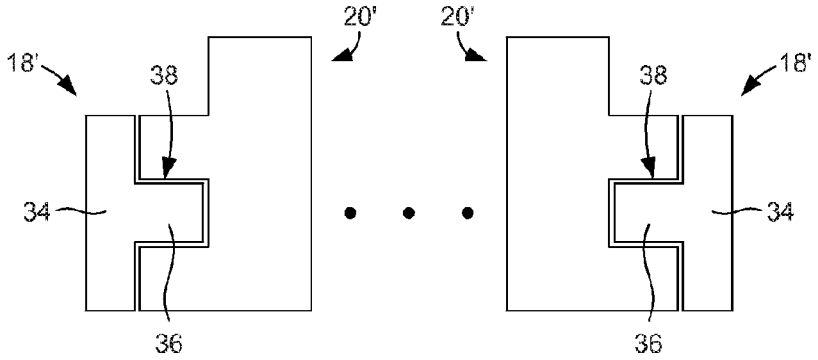
Figure 3C:
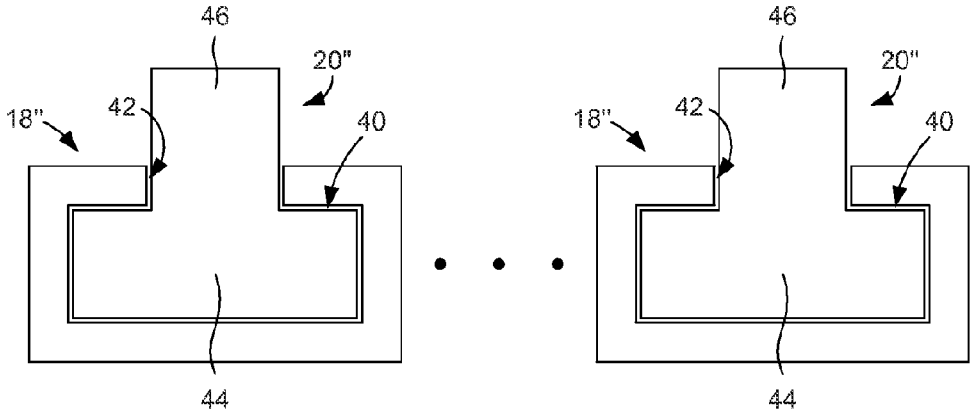

FIGS. 3A-3C illustrate example configurations for the tracks 18 and the diaphragm feet 20. Beginning with FIG. 3A, each track 18 has a C-shaped cross-section and each foot 20 has an L-shaped cross-section. In such a case, the lower portion 30 of the "L" of the foot 20 is received within a channel 32 of the "C" of the track 18. With reference to FIG. 3B, each track 18' has a generally vertical portion 34 from which inwardly extends a generally horizontal rail 36 that is received in a channel 38 of its associated foot 20'. Turning next to FIG. 3C, each track 18" has a rectangular cross-section and forms an inner channel 40 that can be accessed via an upper channel 42 that is formed through the track. With further reference to FIG. 3C, each foot 20" can have an inverted T-shape created by a base portion 44 that occupies the inner channel 40 and a neck 46 that extends through the upper channel 42.

Figure 4:
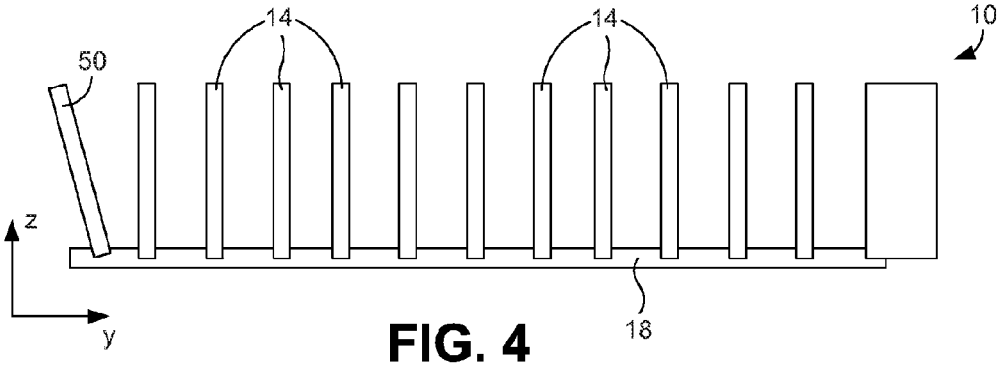
FIG. 4 is a schematic side view of self-restoring crash cushion having a forward-tilted front diaphragm.

Referring next to FIG. 4, the first or front diaphragm 50 of the crash cushion 10 can be tilted forward and downward. This tilting reduces the risk that the first diaphragm 50 will tilt backward and enable an impacting vehicle to climb the front of the crash cushion 10.

A crash cushion such as illustrated in relation to FIGS. 1-4 can be provided with energy dissipation means that slow the motion of the diaphragms during a vehicle impact, to thereby dissipate energy, as well as restoration means that return the diaphragms to their original positions after the vehicle is removed, to thereby restore the crash cushion. Examples of such means are described below in relation to FIGS. 5-16. As will be apparent from these examples, in some cases the energy dissipation means and the restoration means comprise many of the same components.

Figure 5:
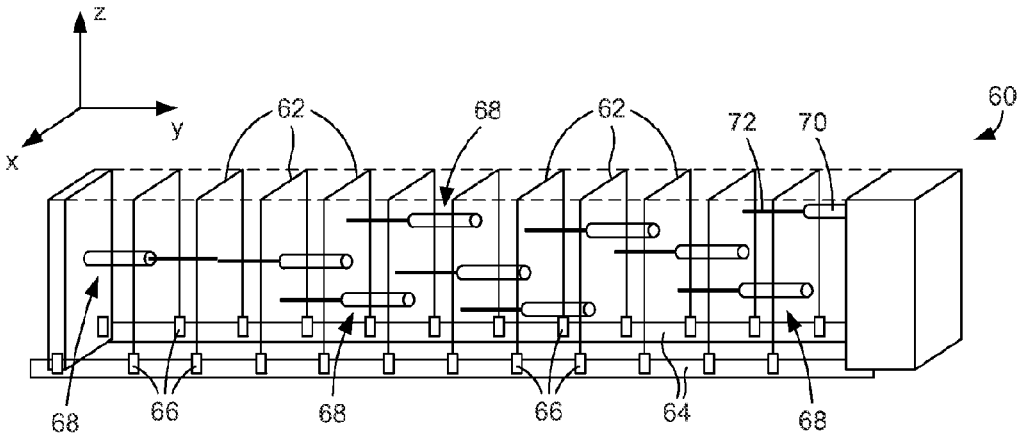
FIG. 5 is a schematic perspective view of a self-restoring crash cushion incorporating hydraulic dissipation and restoration.
Figure 6:
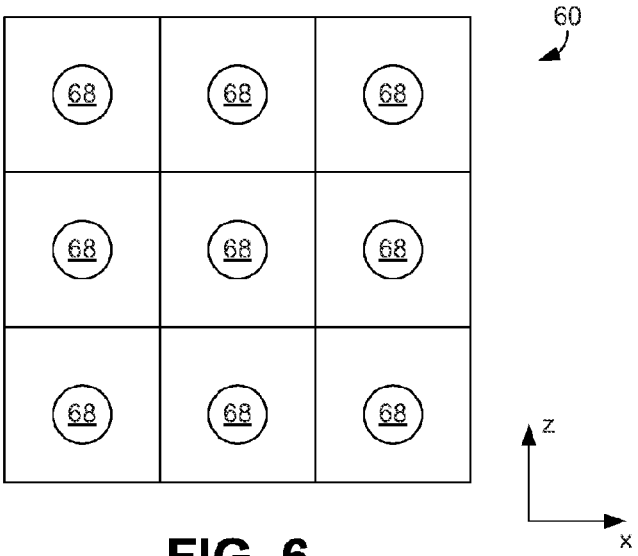
FIG. 6 is a schematic end view of the self-restoring crash cushion of FIG. 5 illustrating spacing of hydraulic actuators of the cushion.

Beginning with FIG. 5, schematically illustrated is a self-restoring crash cushion 60 that uses hydraulic elements to both dissipate energy and restore the cushion. As shown in the figure, the crash cushion 60 comprises multiple spaced diaphragms 62 that are mounted to elongated parallel tracks 64 with feet 66. In addition, the crash cushion 60 comprises multiple hydraulic actuators 68. Each hydraulic actuator 68 includes a cylindrical housing 70 and a piston rod or arm 72 that can be extended from or pressed into the housing. The hydraulic actuators 68 are mounted to the diaphragms 62 so that the distal ends of the arms 72 are attached to a first diaphragm and the proximal ends of the housings 70 are attached to a second diaphragm. In cases in which there are one or more diaphragms 62 or other structures positioned between those two ends, these diaphragms or other structures can comprise openings through which the housing 70 and/or arm 72 of the actuator 68 can pass. Each hydraulic actuator 68 has two states: a first, extended state in which the arm 72 is extended from the housing 70 prior to vehicle impact (as depicted in FIG. 5) and a second, compressed state in which the arm has been pressed into the housing to one degree or another because of total or partial collapse of the crash cushion 60 during vehicle impact.

The hydraulic actuators 68 are staggered within the crash cushion 60 so that they are three-dimensionally spaced from each other. Accordingly, as is apparent from FIG. 5, the hydraulic actuators 68 are spaced from each other along the length direction of the crash cushion 60 (y direction). As is apparent from FIG. 6, which schematically illustrates the crash cushion 60 in an end view, the hydraulic actuators 68 are also spaced from each other in the height direction (z direction) and width direction (x direction) of the crash cushion 60. Such a configuration maximizes the number of hydraulic actuators 68 that can be used in the crash cushion 60 and therefore provides for maximum energy absorption over the length of the cushion. In the illustrated embodiment, the crash cushion 60 includes nine hydraulic actuators 68.

Figure 7A:
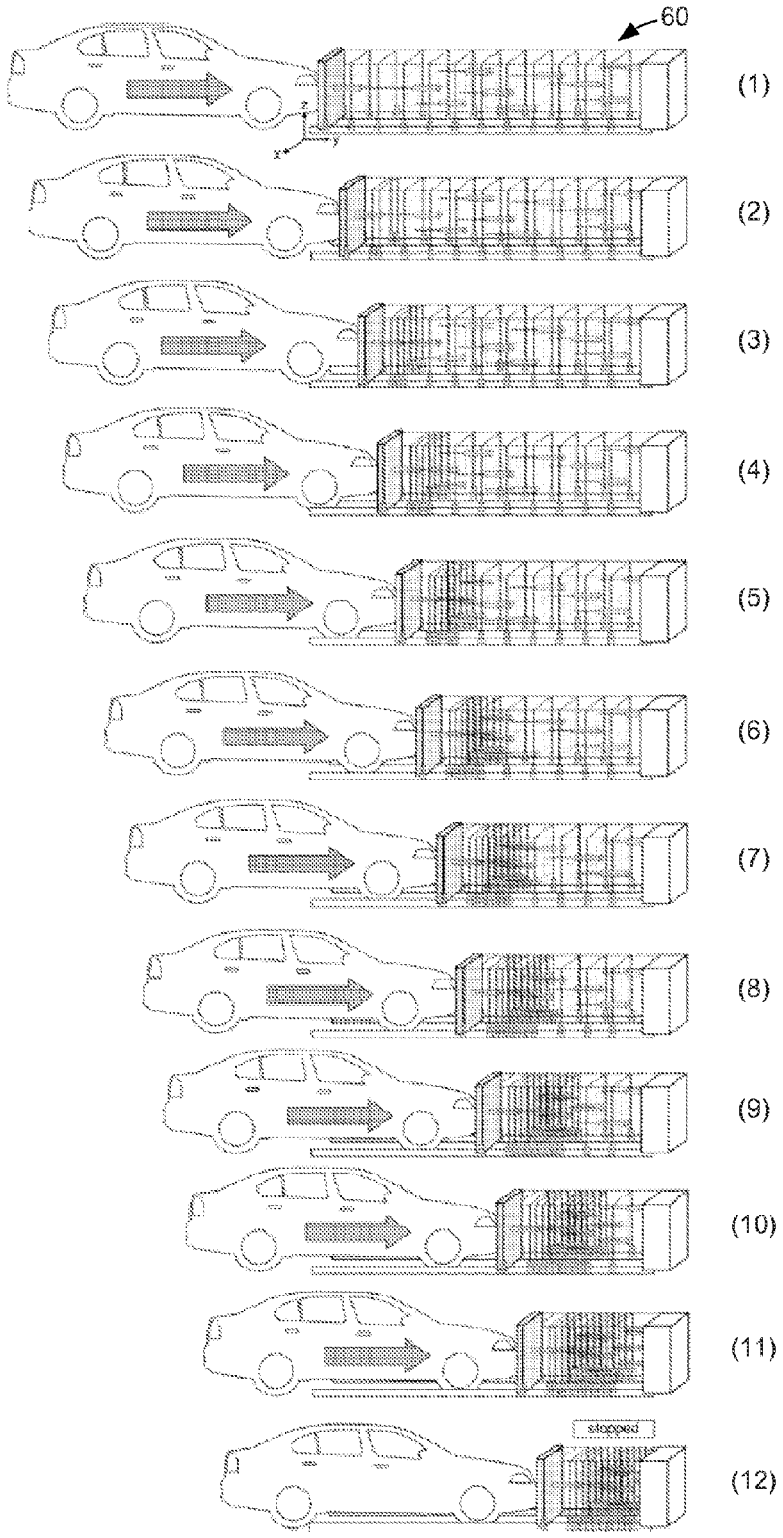
FIG. 7A is a sequential illustration of the collapse of the self-restoring crash cushion of FIG. 5.

FIG. 7A illustrates operation of the crash cushion 60 in the case of a head-on impact by a moving vehicle. More particularly, FIG. 7A sequentially illustrates how the crash cushion 60 collapses during such an impact. Twelve numbered stages of compression are shown in the figure as is the operation of the hydraulic actuators 68. In stage (1), the piston arms 72 of the actuators 68 are all in the initial, extended state. In stages (2) through (12), the crash cushion 60 is compressed by the vehicle. When this occurs, the diaphragms 62 slide rearward along the tracks 64 toward the rear of the crash cushion 60, which sequentially collapses. As this occurs, the hydraulic actuators 68 compress and dissipate energy of the impact until the vehicle is brought to a stop. As each hydraulic actuator compresses, hydraulic fluid, such as oil, is driven out of the actuator and collects in a reservoir (not shown). At stage (12), each of the hydraulic actuators 68 is in a compressed state.

Figure 7B:
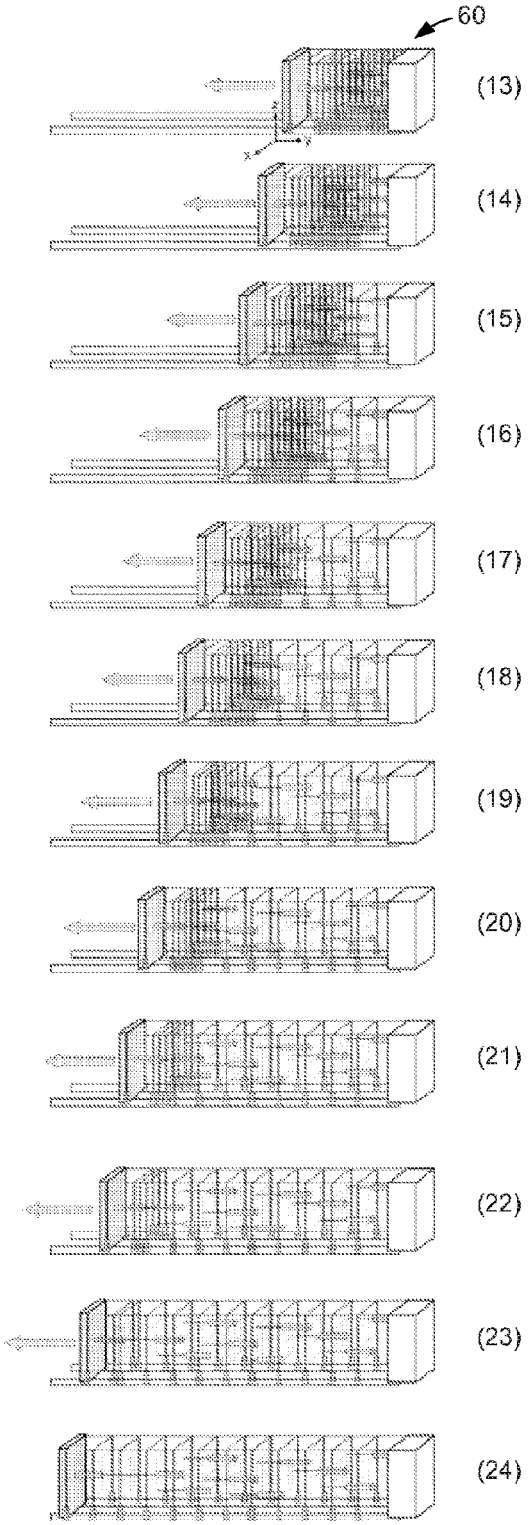
FIG. 7B is a sequential illustration of the restoration of the self-restoring crash cushion of FIG. 5.

After the vehicle has been removed, the crash cushion 60 can be restored so that it will be ready for another impact. FIG. 7B sequentially illustrates this restoration in twelve further stages. During the restoration process, the piston arm 72 of each hydraulic actuator can be re-extended by driving hydraulic fluid back into the housings 70. This can be accomplished through the use of a pump (not shown). As depicted in FIG. 7B, as the arms 72 are once again extended, the diaphragms 62 are moved back to their original positions.

The motion of the diaphragms of a self-restoring crash cushion can be slowed and the original positions of the diaphragms can be restored using other mechanisms. Schematically illustrated in FIG. 8 in plan view is a self-restoring crash cushion 80 that uses a pulley system to both dissipate energy and restore the cushion. As shown in the figure, the crash cushion 80 comprises multiple spaced diaphragms 82 that are mounted to elongated parallel tracks with feet (tracks and feet not shown). The crash cushion 80 further comprises a pulley system in which a rope 84 is wound on a drum 86 positioned at the rear of the cushion. The rope 84 can be any high-strength, high-toughness rope. In some embodiments, the rope 84 is a high-strength wire rope. In other embodiments, the rope 84 is a high-strength, high-toughness fiber rope, such as polymer ropes using nylon or ultra-high molecular weight polyethylene (e.g. Dyneema®), or natural fibers. It may be advantageous to use a wire rope attached to a fiber rope to provide both the wear resistance of steel with the high toughness of advanced fiber rope systems.

Figure 8:
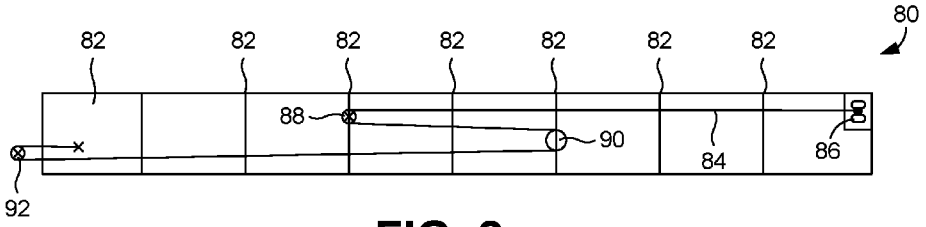
FIG. 8 is a schematic plan view of a self-restoring crash cushion incorporating a pulley system for dissipation and restoration.

Irrespective of its nature, the rope 84 extends from the drum 86 to a first pulley 88 that is located at a medial position along the length of the crash cushion 80. This pulley 88 is securely anchored to the ground (e.g., to a concrete pad or part of the structure supporting the track). In the illustrated embodiment, the pulley 88 is positioned near the third diaphragm 82 from the front of the crash cushion 80. After wrapping around the first pulley 88, the rope 84 changes direction and extends back toward the drum 86 until reaching a second pulley 90 that is mounted to a diaphragm 82 located nearer to the rear of the crash cushion 80. In the illustrated embodiment, the second pulley 90 is mounted to the fifth diaphragm 82 from the front of the crash cushion 80. After wrapping around the second pulley 90, the rope 84 again changes direction and again extends toward the front of the crash cushion 80. As shown in FIG. 8, the rope 84 extends past the front end of the crash cushion 80 and past the front diaphragm 82 to a third pulley 92 that is also securely anchored to the ground. The rope 84 wraps around this pulley 92 and changes direction one last time to extend toward the drum 86 and securely attach to the front diaphragm 82.

Figure 9:
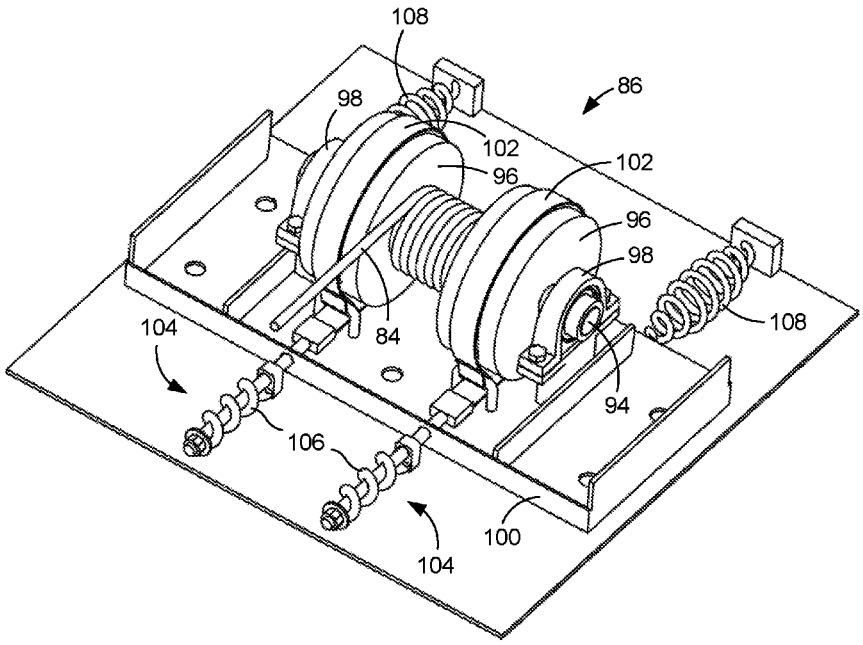
FIG. 9 is a perspective view of a drum upon which a rope of the self-restoring crash cushion of FIG. 8 is wound.

FIG. 9 illustrates an example embodiment for the drum 86 shown in FIG. 8. As illustrated in FIG. 9, the drum 86 includes a shaft 94 upon which the rope 84 is wound. The rope 84 wraps around this shaft 94 with multiple turns to ensure there is an adequate length of rope that can be unwound from the drum 86 in the event of a vehicle impact. Mounted to the shaft 94 are two brake drums 96 that are positioned on either side of the wound rope 84. As shown in FIG. 9, the drums 96 are positioned relatively close to each other so as to form a narrow length of shaft 94 around which the rope 84 can wind. This causes the rope 84 to wind on top of itself and increase the radial distance of the wound rope from the shaft as the rope is wound up. This means that the rope 84 will have a larger moment arm with respect to the shaft 94 when it is first unwound from the drum 86. As described below, this arrangement increases the stopping force provided by the pulley system as the crash cushion 80 collapses to a greater and greater extent.

With further reference to FIG. 9, the shaft 94 is supported at each end by an axle 98. Each axle 98 is mounted to a carriage 100 that can move along the length direction of the crash cushion 80 when high magnitude forces are applied to the rope 84. Wrapped around each brake drum 96 is a flexible band 102 than can be used to slow rotation of its associated brake drum and, therefore, the shaft 94. The first ends of these bands 102 are attached to the carriage 100 and the second ends of the bands are attached to a tensioning mechanism 104 that maintains tension in the band. As is further shown in FIG. 9, first springs 106 associated with the tensioning mechanisms 104 oppose rearward movement of the carriage 100. In a similar manner, second springs 108 are provided that oppose forward movement of the carriage 100.

Figure 10:
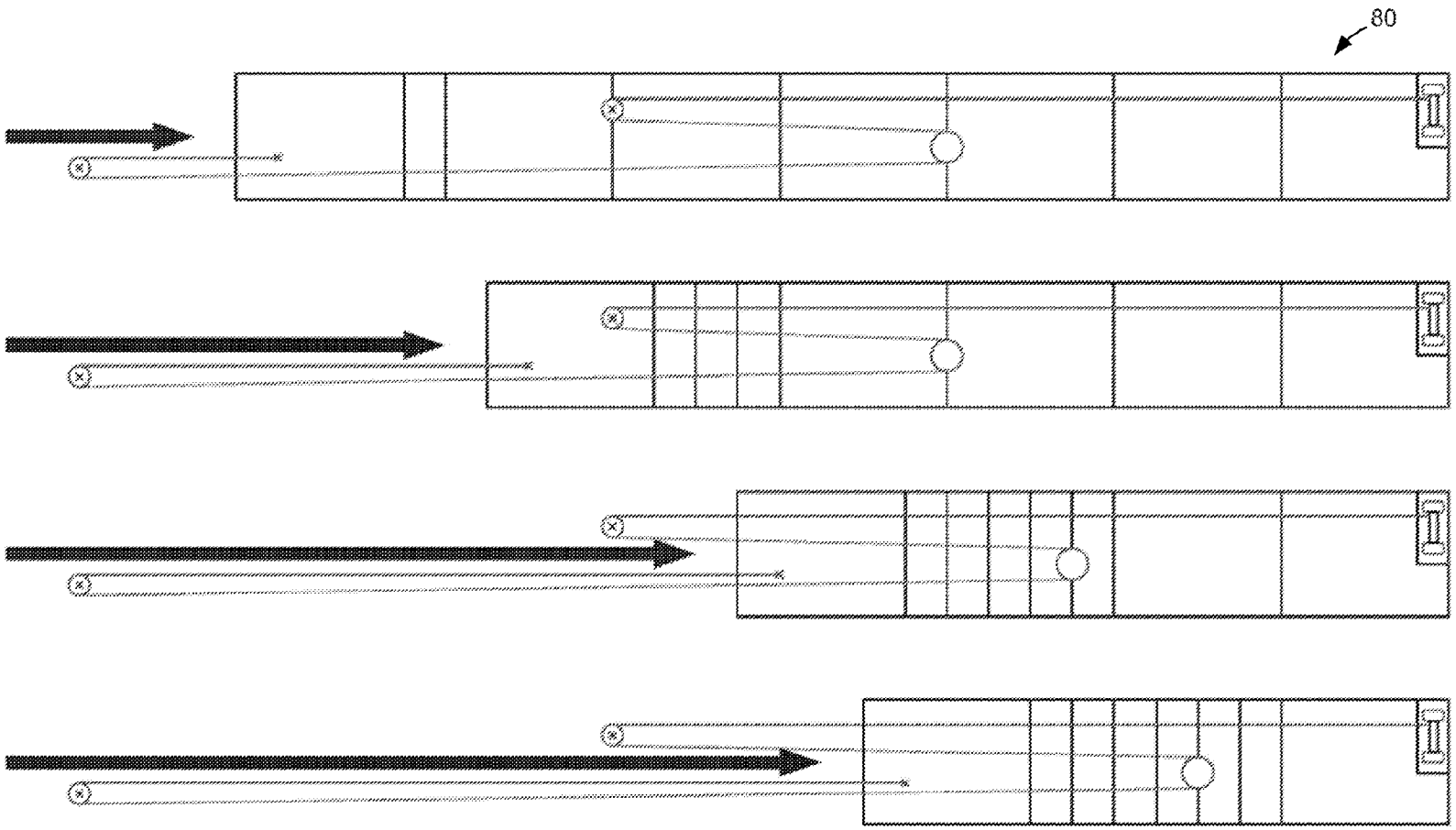
FIG. 10 is a sequential illustration of the collapse of the self-restoring crash cushion of FIG. 8.

FIG. 10 illustrates operation of the crash cushion 80 in the case of a head-on impact by a moving vehicle. More particularly, FIG. 10 sequentially illustrates how the crash cushion 80 collapses during such an impact. Prior to an impact, the bands 102 shown in FIG. 9 are in an initial state in which they tightly wrapped around the brake drums 96 so as to strongly oppose rotation of the drums, the shaft 94, and the rope 84 wound on the shaft. When a vehicle impacts the front diaphragm 82, the diaphragm is driven backward within the crash cushion 80. Because the rope 84 is attached to this diaphragm 82 and because of the configuration of the pulley system, the rope unwinds from the drum 86 as the diaphragm is displaced. If the impact is large, enough force may be transmitted to the rope 84, and the shaft 94, to cause the carriage 100 to shift forward. When this happens, the tension in the bands 102 wrapped around the brake drums 96 is reduced so as to enable the shaft 94 to rotate more quickly and enable the rope 84 to unwind more quickly. This reduces the initial stopping force applied to the vehicle to accommodate situations in which the vehicle is relatively light and may not require a large stopping force.

If the crash cushion 80 continues to collapse, the stopping force increases so that the energy of heavier vehicles can also be dissipated. There are several mechanisms with which the stopping force increases with increasing cushion collapse. First, as the force of the impact is dissipated by the collapsing crash cushion 80, the force in the rope 84 is reduced, which enables the carriage 100 to shift rearward to its original position under the pulling force of the second springs 108 (assuming the carriage was initially pulled forward by the rope). When this occurs, the tension in the bands 102 increases and the bands are tightened on the brake drums 96 to slow the rate at which the rope 84 is unwound from the drum 86. Second, as noted above, the moment arm of the rope 84 wound on the shaft 94 decreases as the rope is unwound from the drum 86. This increases the mechanical advantage of the pulley system and therefore provides greater stopping power. Third, once the vehicle passes the third pulley 90 located near the rear of the crash cushion 80, the initial braking force is tripled because of the mechanical advantage provided by the additional pulley. Operating in this manner, the pulley system dynamically adjusts to apply the braking force that is necessary for the particular incident.

It is noted that, while band brakes are illustrated in FIG. 9, braking can be provided by other rotary brakes, such as drum brakes or disk brakes.

After the vehicle is brought to a stop by the crash cushion 80, the vehicle can be removed and the crash cushion can be restored to its initial orientation. This restoration can be achieved by rewinding the rope 84 onto the drum 86 using a motor (not shown). When the rope 84 is rewound onto the drum 86, the diaphragms 82 are pulled back to their original positions. In some embodiments, the motor can be solar-powered, using batteries to store energy, and programmed to activate after a specified duration following an impact event. This would make the crash cushion self-restoring, thus eliminating the need for maintenance crews to be placed in harm's way while dramatically reducing repair costs.

Figure 11:
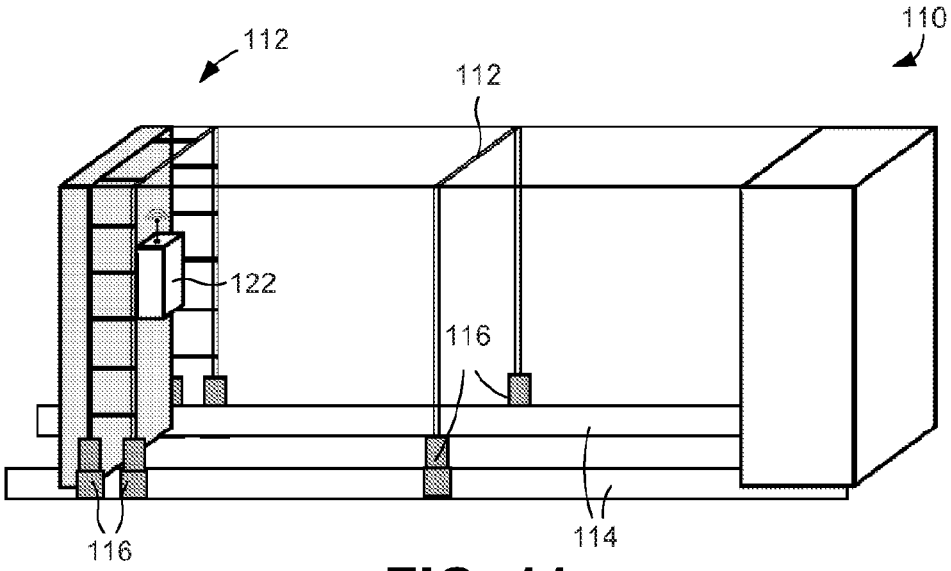
FIG. 11 is a schematic plan view of a further self-restoring crash cushion incorporating a pulley system for dissipation and restoration.
Figure 12:
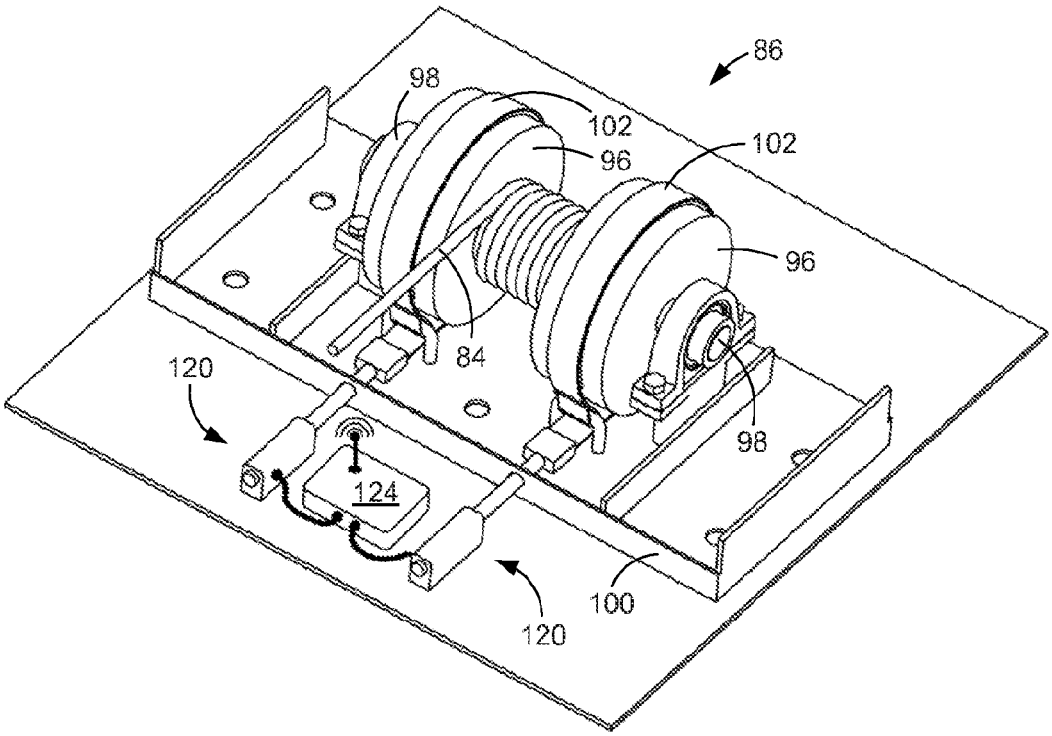
FIG. 12 is a perspective view of a drum upon which a rope of the self-restoring crash cushion of FIG. 11 is wound.

FIGS. 11 and 12 illustrate a variation of the crash cushion 80 shown in FIGS. 8-10. Like the crash cushion 80, the crash cushion 110 comprises multiple spaced diaphragms 112 that are mounted to elongated parallel tracks 114 with feet 116. The crash cushion 110 also includes a pulley system similar to that described above in relation to FIGS. 8-10. As shown in FIG. 12, the pulley system includes a drum 86 that comprises a shaft 94 upon which the rope 84 is wound and brake drums 86 are mounted. Wrapped around each brake drum 96 is a flexible band 102 than can be used to slow rotation of its associated brake drum and, therefore, the shaft 94. In this case, however, the carriage 100 is fixed in place and the tension in the bands 102 can be adjusted with linear actuators 120 instead of by movement of the carriage.

With reference back to FIG. 11, the front diaphragm 112 is provided with a sensor unit 122 that includes a sensor, such as an accelerometer that can measure the speed at which the diaphragm is accelerated in the case of a vehicle impact, and a wireless transmitter that can wirelessly transmit the measurements in real time to a controller 124 in communication with the linear actuators 120. The controller 124 comprises circuitry that controls the amount of tension applied to the bands 102 by the linear actuators so that the most appropriate stopping force can be applied. By way of example, the linear actuators 120 can be electronic actuators, hydraulic actuators, or pneumatic actuators.

Figure 13:
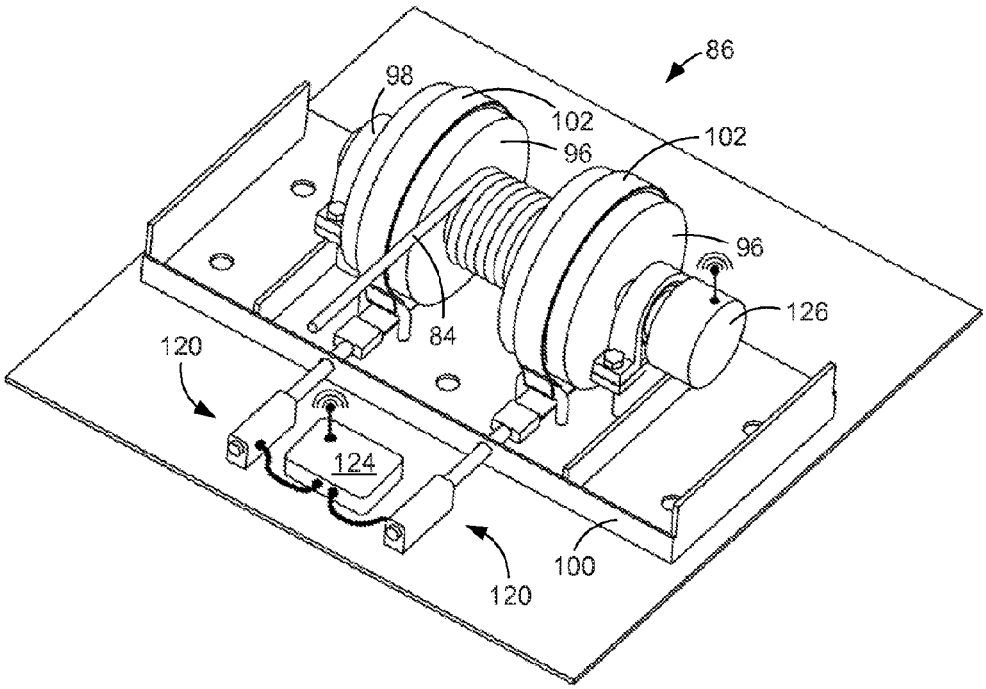
FIG. 13 is a perspective view of an alternative drum upon which a rope of a self-restoring crash cushion can be wound.

FIG. 13 illustrates another band braking example in which the tension in the band 102 can be adjusted using linear actuators 120 under the control of the controller 124. In this case, however, the controller 124 receives rotational motion measurements from a sensor unit 126 that includes a sensor, such as a rotational accelerometer or a rotary variable differential transformer, that can measure the rate at which the drum 86 is accelerated in the case of a vehicle impact and a wireless transmitter that can wirelessly transmit the measurements in real time to the controller 124. It is noted that, for each case in which wireless communication is shown, a hard-wired scheme can alternatively be used.

Figure 14:
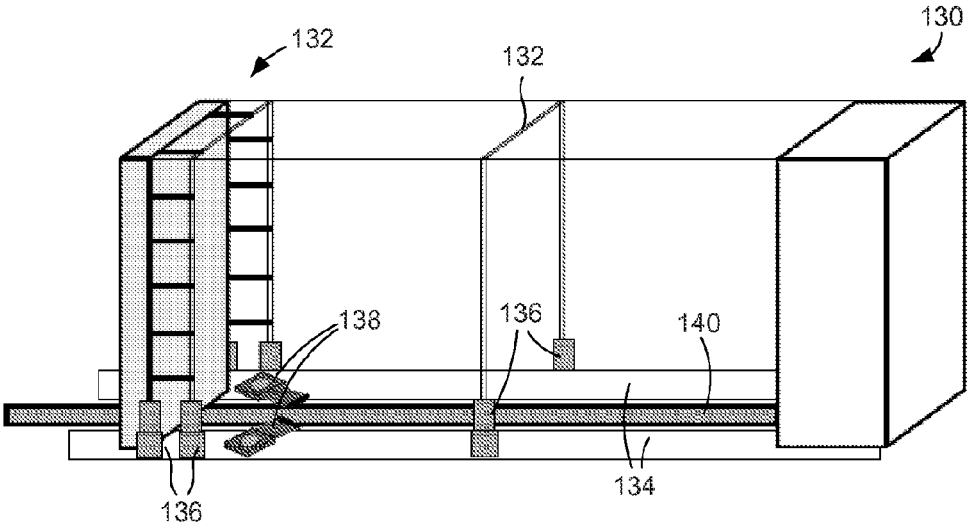
FIG. 14 is a schematic perspective side view of a self-restoring crash cushion incorporating diaphragm braking for dissipation.
Figure 15:
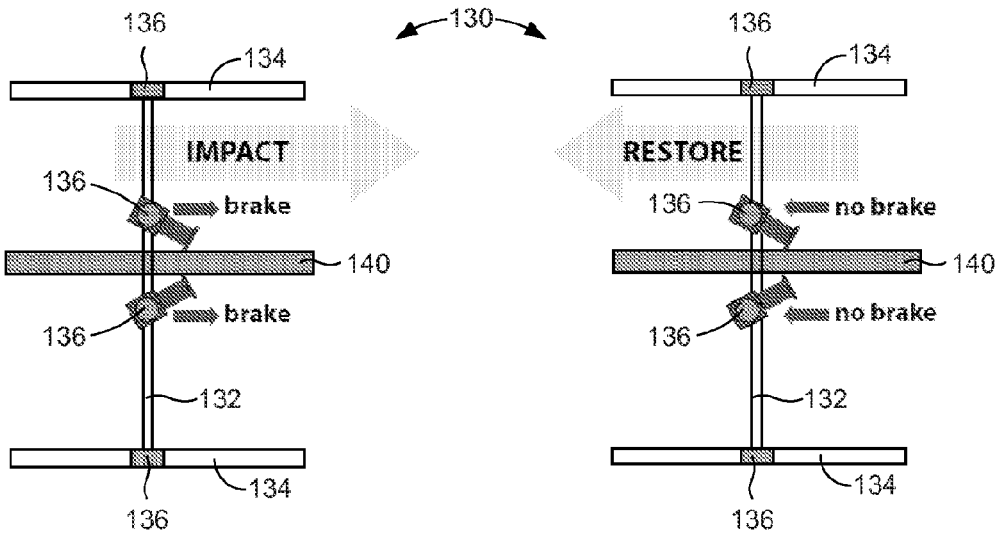
FIG. 15 is a schematic diagram that illustrates dissipation and restoration of the self-restoring crash cushion of FIG. 14.

Force dissipation can alternatively be provided by brakes mounted to the diaphragms of a crash cushion. FIGS. 14 and 15 illustrate an example of this. Beginning with FIG. 14, illustrated is a crash cushion 130 that comprises multiple spaced diaphragms 132 that are mounted to elongated parallel tracks 134 with feet 136. Mounted to at least one of the diaphragms 132, such as the front diaphragm, are passive unidirectional brakes 138 that oppose movement of the diaphragm in the rearward (dissipation) direction but do not oppose movement of the diaphragm in the forward (restoration) direction. In some embodiments, the brakes 138 can bite into an elongated metal rail 140 that extends along the length direction of the crash cushion 130 when the diaphragm 132 is moved rearward. In some embodiments, each brake 138 comprises an angled piece of metal and, optionally, a spring (not shown) that urges the metal into contact with the rail 140.

As depicted in FIG. 15, as the diaphragm 132 is moved rearward (to the right in FIG. 15), the brakes 138 bite into the rail 140 and thereby dissipate energy. Once the impact is over and the car is removed, the crash cushion 130 can be restored, for example, using a pulley system similar to that described above in relation to FIGS. 8-10. During restoration, the diaphragms 132 and brakes 138 are moved forward (to the left in FIG. 15) and the brakes do not bite into the rail 140.

Figure 16:
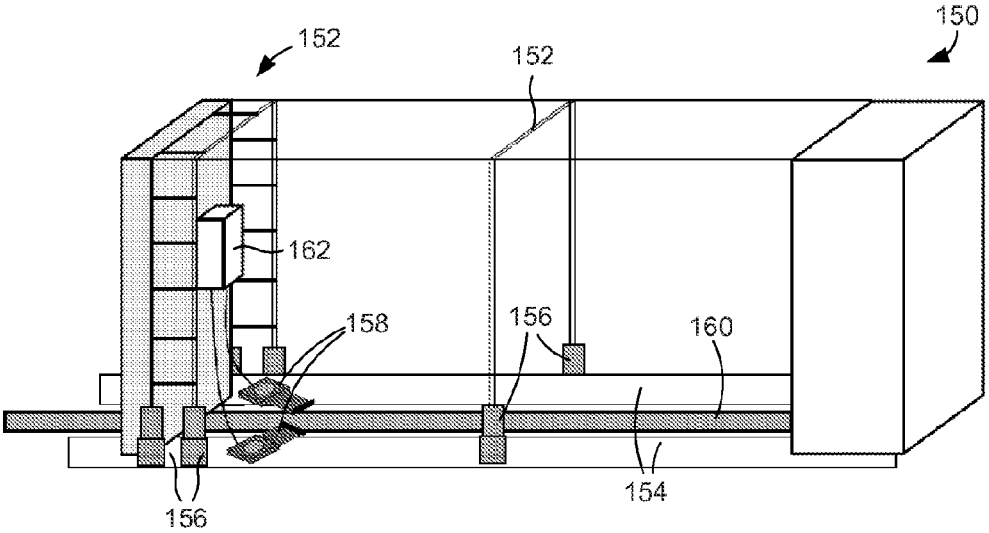
FIG. 16 is a schematic perspective side view of a further self-restoring crash cushion incorporating diaphragm braking for dissipation.

FIG. 16 illustrates another crash cushion 150 that uses brakes provided on a diaphragm. As shown in this figure, the crash cushion 150 comprises multiple spaced diaphragms 152 that are mounted to elongated parallel tracks 154 with feet 156. Mounted to at least one of the diaphragms 152, such as the front diaphragm, are brakes 158 that can be actuated to oppose movement of the diaphragm in the rearward (dissipation) direction. In some embodiments, the brakes 158 can comprise calipers that pinch an elongated metal rail 160 in response to accelerations detected by a sensor unit 162 mounted to the diaphragm 152.

The invention claimed is:

1. A crash cushion comprising:

multiple diaphragms spaced along a length direction of the crash cushion;

an elongated track adapted to be anchored to the ground that extends along the length direction under the crash cushion, the diaphragms being mounted to the track in a manner in which they can slide along the track when impacted by a moving vehicle or when the crash cushion is being restored; and a pulley system that includes a first pulley that is anchored to the ground in front of the crash cushion, a rope that wraps around the first pulley and is attached to a front diaphragm of the crash cushion, and a drum that is anchored to the ground near a rear of the crash cushion, the drum including a shaft upon which the rope is wound and a rotary brake adapted to resist rotation of the shaft.

2. The crash cushion of claim 1, wherein the rotary brake is a band brake including a flexible band that is wrapped around a brake drum mounted to the shaft.

3. The crash cushion of claim 2, further including a tensioning mechanism that applies tension to the band.

4. The crash cushion of claim 3, wherein the drum can move along the length direction of the crash cushion to change the tension applied by the tensioning mechanism.

5. The crash cushion of claim 3, wherein the tensioning mechanism adjusts the tension in the band in response to measurements collected by a sensor on the cushion.

6. The crash cushion of claim 1, further comprising a motor for winding the rope back onto the drum after a portion of it has been unwound due to the impact to enable self-restoration of the crash cushion.

7. The crash cushion of claim 1, wherein the pulley system further comprises a second pulley that is positioned between the first pulley and the drum, wherein the rope wraps around the second pulley before reaching the drum.

8. The crash cushion of claim 7, wherein the pulley system further comprising a third pulley that is positioned between the first pulley and the second pulley, wherein the rope wraps around the third pulley after wrapping around the second pulley but before reaching the drum.

9. The crash cushion of claim 4, wherein the drum includes a carriage to which the shaft is mounted, the carriage being configured to move along the length direction of the crash cushion.

10. The crash cushion of claim 9, wherein a first end of the band is attached to the carriage and a second end of the band is attached to the tensioning mechanism.

11. The crash cushion of claim 10, wherein the tensioning mechanism includes a first spring associated with the band, wherein rearward movement of the front diaphragm resulting from an initial phase of the impact increases tension in the rope and pulls the carriage in a forward direction and wherein forward movement of the carriage decreases tension applied by the spring to the band, which in turn enables the shaft to rotate relatively easily.

12. The crash cushion of claim 11, wherein slowing of the front diaphragm during a later phase of the impact decreases tension in the rope and enables the carriage to move in a rearward direction and wherein rearward movement of the carriage increases tension applied by the spring to the band, which in turn causes the shaft to rotate less easily.

13. The crash cushion of claim 12, wherein the drum further comprises a second spring associated with the carriage, wherein the second spring opposes forward movement of the carriage.

14. A crash cushion comprising:

multiple diaphragms spaced along a length direction of the crash cushion;

an elongated track adapted to be anchored to the ground that extends along the length direction under the crash cushion, the track comprising elongated rails to which the diaphragms are mounted in a manner in which they can slide along the rails when impacted by a moving vehicle or when the crash cushion is being restored; and brakes mounted to the diaphragms that are configured to bite into the rails to dissipate energy as the diaphragms are moved along the track during an impact.

15. The crash cushion of claim 14, wherein the brakes are passive unidirectional brakes that opposes motion of the diaphragms to which they are attached in a rearward direction but do not oppose motion of the diaphragms to which they are attached in a forward direction.

16. The crash cushion of claim 14, further comprising a sensor mounted to one of the diaphragms, wherein one or more of the brakes are actuated in response to measurements made by the sensor.

17. The crash cushion of claim 14, further comprising a pulley system that can be used to pull the diaphragms back to their original positions.

18. The crash cushion of claim 14, wherein the brakes comprise angled pieces of metal that contact the rails.

19. The crash cushion of claim 18, further comprising springs that urge the pieces of metal into contact with the rails.

20. The crash cushion of claim 16, wherein the brakes comprise brake calipers that are configured to pinch the rails in response to the measurements.

* * * * *